US007299615B2

(12) United States Patent
Kersey

(10) Patent No.: US 7,299,615 B2
(45) Date of Patent: Nov. 27, 2007

(54) VARIABLE TWIST LEVEL YARN USING FLUID TWISTING

(75) Inventor: Brandon S. Kersey, Rocky Face, GA (US)

(73) Assignee: Mannington Mills, Inc., Salem, NJ (US)

( * ) Notice: Subject to any disclaimer, the term of this patent is extended or adjusted under 35 U.S.C. 154(b) by 0 days.

(21) Appl. No.: 11/155,196

(22) Filed: Jun. 17, 2005

(65) Prior Publication Data

US 2005/0279075 A1 Dec. 22, 2005

Related U.S. Application Data

(60) Provisional application No. 60/580,965, filed on Jun. 18, 2004.

(51) Int. Cl.
*D01H 4/02* (2006.01)

(52) U.S. Cl. ..... 57/264; 57/350

(58) Field of Classification Search ..... 57/264, 57/265, 293, 314, 333, 350
See application file for complete search history.

(56) References Cited

U.S. PATENT DOCUMENTS 3,981,130 A 9/1976 Aimbinder et al.
4,034,544 A 7/1977 Clarkson
4,266,397 A 5/1981 Dönmez et al.
4,276,740 A 7/1981 Chambley et al.
4,329,841 A 5/1982 Mang
4,375,744 A 3/1983 Briner et al.
4,606,181 A 8/1986 Lappage et al.
4,736,579 A 4/1988 Stenmans
4,922,703 A 5/1990 Matsui et al.
5,048,281 A * 9/1991 Dallmann et al. ..... 57/264
5,060,467 A 10/1991 Gill et al.
5,150,566 A 9/1992 Stenmans
5,174,102 A 12/1992 Matsui et al.
5,237,805 A 8/1993 Menegatto
5,706,642 A 1/1998 Haselwander
6,345,491 B1 * 2/2002 Moran et al. ..... 57/333
6,438,934 B1 * 8/2002 Foster et al. ..... 57/328
6,655,122 B2 * 12/2003 Shigeyama et al. ..... 57/5

* cited by examiner

*Primary Examiner*—Shaun R. Hurley
(74) *Attorney, Agent, or Firm*—Kilyk & Bowersox, P.L.L.C.

(57) ABSTRACT

A method and apparatus for twisting two or more strands of yarn together in accordance with a pre-selected and changeable pattern so as to obtain twisted yarn with a selected twist level extending for a selected length of the yarn and other selected twist levels and/or twist directions extending for various other lengths of the yarn so that a package of finished yarn has a variable twist pattern which is reproducible and changeable. The yarn twisting apparatus has a drive for pulling the yarn through the twist inserting apparatus, and controllable fluid twisting devices for twisting the yarn together. A programmable controller controls ratios of the speeds at which the product package drive is operated and pressures or other parameters of fluid jets effecting fluid twisting of the yarn. The programmable controller can also vary the time that each selected ratio is maintained.

15 Claims, 7 Drawing Sheets

VARIABLE TWIST LEVEL YARN USING FLUID TWISTING

This application claims the benefit under 35 U.S.C. §119 (e) of prior U.S. Provisional Patent Application No. 60/580,965 filed Jun. 18, 2004, which is incorporated in its entirety by reference herein.

BACKGROUND OF THE INVENTION

The present invention relates to twisting of yarn or threads and more particularly to twisting of at least two separate yarn or thread strands in accordance with selected patterns. The present invention also relates to carpets and textile substrates using twisted yarn.

In the art of twisting yarn and thread, hereinafter together referred to as yarn twisting, a pre-determined twist level and twist direction is selected and remains constant for a particular finished yarn. Twist level is defined as the turns of twist or wrap of the yarn or thread about each other for a given segment of length of the twisted yarn or thread. The twisting of yarn comprises twisting at least one strand or ply of yarn together or about another such that there is a pre-determined number of turns of yarn twisted with or wrapped about another yarn. Various twisting techniques are utilized in the art to obtain a twisted multiple ply yarn product. For example, ring twisting wherein strands of yarn pass through a ring and are twisted as the ring rotates about a rotating bobbin on which the yarn is wound; two-for-one twisting wherein two bobbins of yarn are combined within a common can, pass through the center of a rotating yarn twister spindle and out a radial hole; and cabling wherein one or more yarn strands enter the bottom of a rotating twister spindle at the center and exit through a radial hole and enters an eyelet or ring to form a balloon which throws out about a supply bobbin of another yarn with which it is twisted, are three such methods for twisting yarn strands together or one or more yarns twisted about another yarn. In each method it is the general practice to maintain the twist level or number of turns per inch of the yarn constant. Machines that perform these methods include a common drive motor, and the ratio between the yarn speed and the final yarn package speed, which determines the twist level, is obtained by the use of change twist gears. Thus, the twist level of a particular yarn is constant and is monitored to remain constant. In order to change twist level, different change twist gears are utilized, but this can only be done for one twisted yarn at a time, i.e., a single yarn has only one twist level.

It has been found that if the twist level of a given yarn may be varied along its length, products made from such yarn, such as carpet, may have unusual aesthetic styling. In the prior art, an attempt to obtain twist variation along the length of the yarn was proposed in Lloyd (U.S. Pat. No. 2,933,881), which utilizes a variable speed device wherein the output speed is controlled by a control lever either moved by a cam or manually moved to change the speed of the yarn take-up spool to vary the twist of the yarn within the final package. It clearly is impracticable to vary the twist manually with such an apparatus since reproducible results would not be obtainable. If a cam is used to create the twist level variation, the variation is limited by the shape and size of the cam, and if another pattern of twisting levels is desired, the cam must be changed.

Yamada et al. (U.S. Pat. No. 4,569,192) involves single strand spun yarns wherein the fibers are spun, drafted and twisted. It was proposed to vary the twist and drafting of the strand while the spun yarn strand is being formed in yarn spinning equipment.

However, there is no known proposal of a system for forming a twisted yarn having multiple plies of yarn which eliminates the need for changing gears, cams or other mechanical or manual devices, which employs fluid twisting or entanglement of the yarn, and which permits large twist pattern variations in the product such that the length of the segments of a desired twist level may be varied along with the twist level and/or the twist direction. Such yarn can be utilized for forming carpet or other textiles with unique and different patterns and aesthetics. Accordingly, it is desirable to provide a system whereby variations in yarn twist level and/or twist direction may be selectively made and wherein wide variations may be selected when twisting multiple strands of yarn together into a composite twisted yarn.

SUMMARY OF THE PRESENT INVENTION

Consequently, it is desirable according to various embodiments to provide a method and apparatus for twisting two or more strands of yarn into a twisted yarn while varying the twist level and/or twist direction selectively along selected lengths of the yarn.

It is also desirable according to various embodiments to provide a method and apparatus for twisting two or more yarn strands together in accordance with a selective twist pattern and for changing the pattern selectively.

According to various embodiments, a method for twisting at least two yarn strands together into a twisted yarn product includes providing a supply of the yarn strands, providing at least one fluid jet device having a controllable fluid blast, providing a rotatable feed roll, and storing in a programmable controller data for control of the at least one fluid jet device and the rotatable feed roll in a manner suitable to generate a pattern made up of variations in at least one of the twist level and the direction of twist of a finished twisted yarn product along the length of the yarn. The method includes controlling the fluid blast from the at least one fluid jet device to effect a desired yarn twist on the yarn strands, such as by controlling the pressure of the fluid provided to the fluid jet device, controlling rotation of the feed roll to feed the yarn strands at a predetermined speed of travel between the supply of yarn strands, the at least one fluid jet device and a package of the finished twisted yarn product, and controlling the fluid blast and the rotation of the feed roll according to the data stored in the programmable controller to provide at least one of a first twist level and a first twist direction of the yarn for a first length of the finished twisted yarn product, and at least one of a second twist level and a second twist direction of the yarn for a second length of the finished twisted yarn product.

According to various embodiments, a system for twisting at least two yarn strands together into a finished twisted yarn having a twist level and/or a twist direction that is varied along its length in accordance with a pattern includes a supply of yarn strands, at least one fluid jet device adapted to impose a twisting torque on individual yarn strands, a rotatable feed roll adapted to feed the yarn strands at a predetermined speed of travel between the supply of yarn strands, the at least one fluid jet device and a package of the finished twisted yarn product, and a control device that selectively rotates the rotatable feed roll and operates the at least one fluid jet device at selected speeds for a selected first time period to provide at least one of a first twist level and a first twist direction of the yarn strands for a first length of the finished twisted yarn product, and that selectively rotates the rotatable feed roll and operates the at least one fluid jet device at selected speeds for a selected second time period to provide at least one of a second twist level and a second twist direction of the yarn strands for a second length of the finished twisted yarn product.

In accordance with various embodiments, various patterns may be stored in a processing device or controller which controls the final pattern of the yarn and can be programmed to make various patterns. Changing from one pattern to another merely involves accessing the pattern from stored information in the processing device.

DETAILED DESCRIPTION OF THE PRESENT INVENTION

Figure 1:
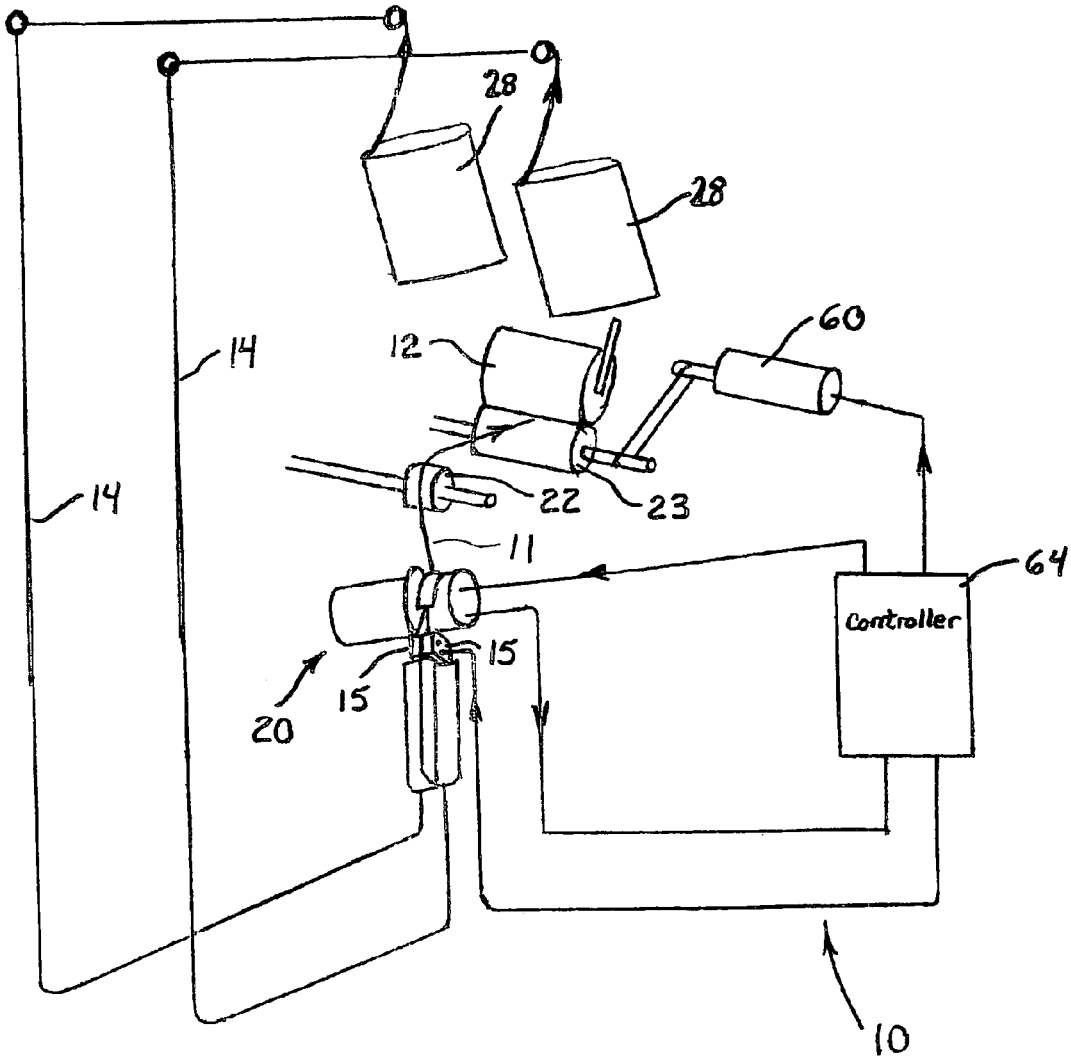
FIG. 1 is a diagrammatic view illustrating an apparatus for the twisting of two yarn strands together using an fluid twisting device into a twisted yarn product and having patterning apparatus constructed in accordance with an embodiment of the present invention.
Figure 4:
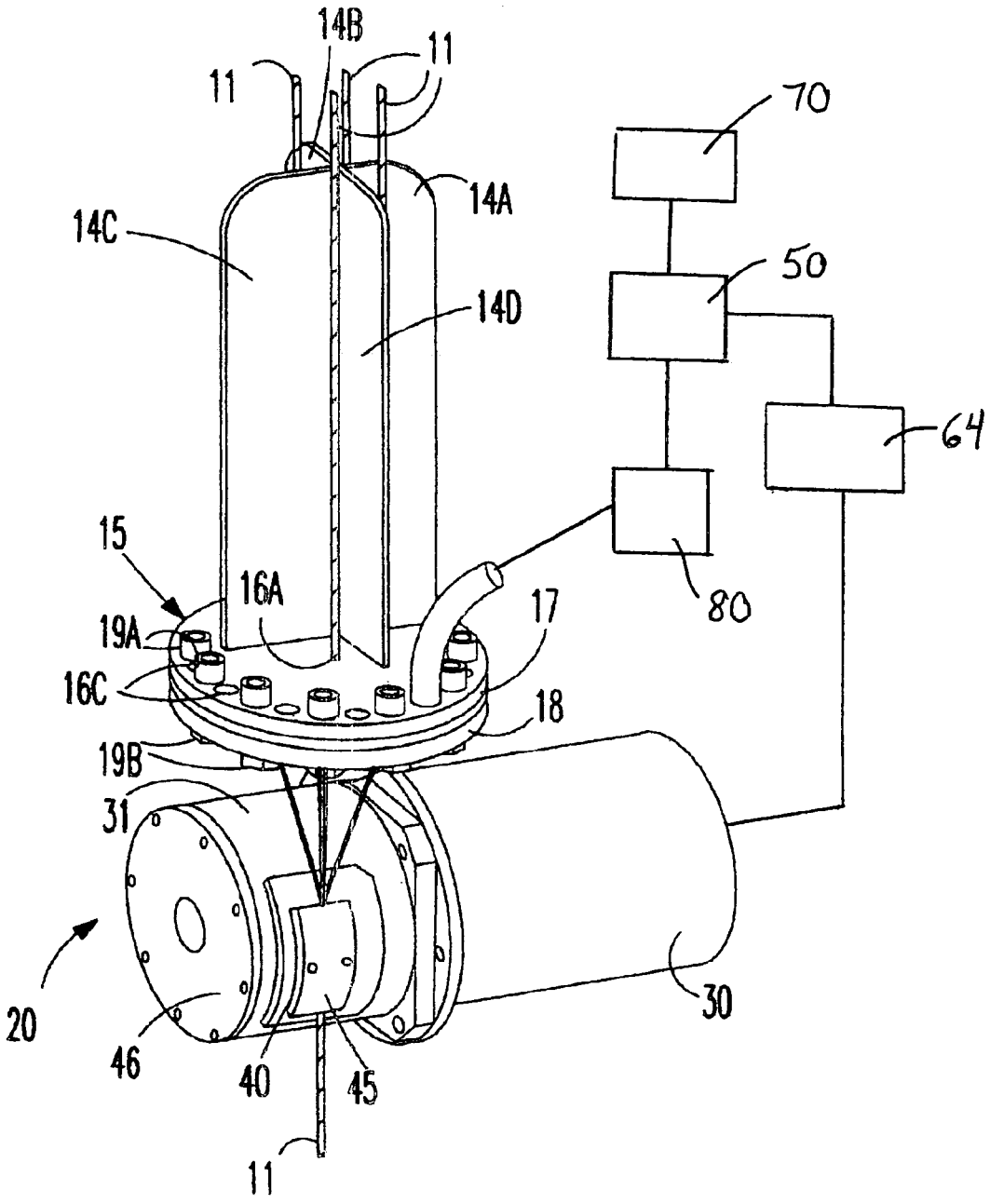
FIG. 4 is a view of another embodiment of a rotary fluid-jet assembly.

In general, the present invention relates to methods to form variable twisted yarn. The methods involve forming twisted yarn by fluid twisting. For purposes of the present invention, the use of fluid to cause twisting is discussed, but any fluid capable of causing the twisting of the yarn can be used and is consider part of the present invention, including any gas and/or liquid, such as water, steam, carbon dioxide, inert gases, and the like. Further, the present invention in one or more embodiments involves means to vary the amount of twists in twisted yarn by varying the pressure and/or volume of the fluid (e.g., air) that contacts the yarn to cause the twisting of the yarn and/or involves varying the speed of the yarn passing through the device that causes the twisting of the yarn. Generally, at least two strands of yarn form the final twisted yarn, each strand of yarn that is false twisted can be twisted to the same or different level. When more than one fluid feed is use to cause the twisting of the two or more yarns (for instance, one fluid stream per yarn to be false twisted), each fluid feed can be varied similarly or differently at the same or different pre-determined time intervals. Thus, at one point, the pressure can be 100 psi and then at a pre-determined time, can be varied to a different psi and so on to achieve a variation in the amount or level of twist in the yarn. For instance, the psi of the fluid can be from 2 psi to 200 psi or more. As described in detail below, when the yarns that have been twisted (false twisted) are brought together to essentially unwind upon each other to form the twisted yarn, the amount of twist previously present in the false twisted individual yarns leads to the twisting together of the various yarns and the formation of a length of yarn that has variation in the twist level due to the variations of the false twisted yarn. The variation in twist level can be any amount of variation for any length of twisted yarn. Referring now to the drawings, FIG. 1 illustrates a multiple yarn package cabling type twisting system 10 for twisting two yarns into a product package 12 of twisted yarn. Although only one station of a package 12 is illustrated, it should be understood that a yarn twisting facility may have many such stations being formed simultaneously, one hundred such stations not being uncommon. Additionally, although FIG. 1 illustrates the twisting of two yarn strands 14 which is the usual situation, three or more such yarns may be twisted together at one station by a single twister, such as shown in the embodiment of FIG. 4. Each of the strands 14 is drawn from a supply package 28 conventionally mounted overhead on a creel (not illustrated) and is fed to twist-inserting apparatus such as air jets 15, shown in FIG. 1, and a rotary air-jet assembly 20.

The combination of the twist-inserting air jets 15 and rotary air-jet assembly 20 combines the individual strands of yarn into a plied yarn 11, which is then guided around package take-up rolls 22, 23 before delivering the plied yarn to a take-up package 12. While a package roll is discussed, it is understood that any collection device can be used or the twisted yarn can be processed in a production line to make textile substrates.

The number of turns or twists of the yarn per minute, the direction of twist, and the distance between segments of plied yarn having twist in a desired direction can be derived from the pressure, amount, and direction of air flow provided through twist inserting apparatus 15 and control of an air blast provided by rotary air-jet assembly 20 as the plied yarn 11 is fed through the rotary air-jet assembly 20 on the way to package take-up rolls 22, 23. The turn per inch of yarn or twist level in the yarn package can be derived from the differential or ratio between the rate at which a twist is applied to each of the yarn threads by the air jets in twist inserting apparatus 15 and/or any additional twist imposed by the air jet within rotary air jet assembly 20, and the speed of the package take-up rolls 22, 23. Control of the rate of movement of an air jet within the rotary air jet assembly 20 can also be used to create zones of intermingled yarns at spaced-apart points along the length of the yarn strands to prevent torsional movement of one yarn relative to the other yarn. The length of the zones of intermingled yarns can be controlled by controlling the rate of speed at which the air jet within rotary air jet assembly 20 is moved relative to the rate of travel of the yarns through the air jet assembly.

Conventionally, the ratio of the speed at which twist is applied to the individual yarns and the speed at which the finished yarn is taken up on the final package is fixed and often determined by the use of gearing.

According to various embodiments, and as shown in an exemplary embodiment in FIG. 1, a motor 60 can be utilized to drive one or more of the package take-up rolls 22, 23. The motor 60 can be connected to a programmable controller 64 for controlling the speed of the motor 60. The programmable controller 64 can also provide signals to control apparatus such as fluidic valves, pressure transducers, electrical solenoid valves or mechanically operated valves, (not shown) that in turn control the pressure and/or flow of air to the twist inserting apparatus 15 as well as to the rotary air jet assembly 20. The air jets within twist inserting apparatus 15 can be controlled by the controller 64 to change the number of twists per a predetermined length of yarn, as well as being operated to control the direction of twist in the yarn and periodic reversals in the direction of twist in the yarns. As described in more detail in U.S. Pat. No. 6,089,009, which is incorporated herein in its entirety by reference, the twist inserting apparatus 15 can include a bore through which the yarn passes, and air ducts that communicate with the bore for communicating air flow. The axes of the air ducts can be laterally offset with respect to the axis of the bore through which the yarn passes, so that the air impinges tangentially on the yarn to produce either a clockwise or counterclockwise twist in the yarn. The velocity and flow rate of the air provided to the twist inserting apparatus can be varied to control the number of twist per a predetermined length of yarn.

Methods for producing "false-twist" and "self-twist" yarns are known in the art, such as described in U.S. Pat. No. 4,276,740, which is incorporated herein in its entirety by reference. The term "false-twist" refers to a yarn in which a yarn strand is twisted by a twist insertion device to generate opposite twists on either side of the device. The point in the strand where the twist reverses has zero twist and is referred to as a node. The directions of twist are referred to as "S-twist" or "Z-twist." The term "self-twist" is applied to yarns wherein two or more false twisted strands are brought together and permitted to ply themselves. The approximately equal torsional force of the same direction is stored in two or more single yarns which are later brought into contact. The torque is released, permitting the single yarns to untwist, and in so doing, wrap around each other to form a plied yarn.

Figure 2:
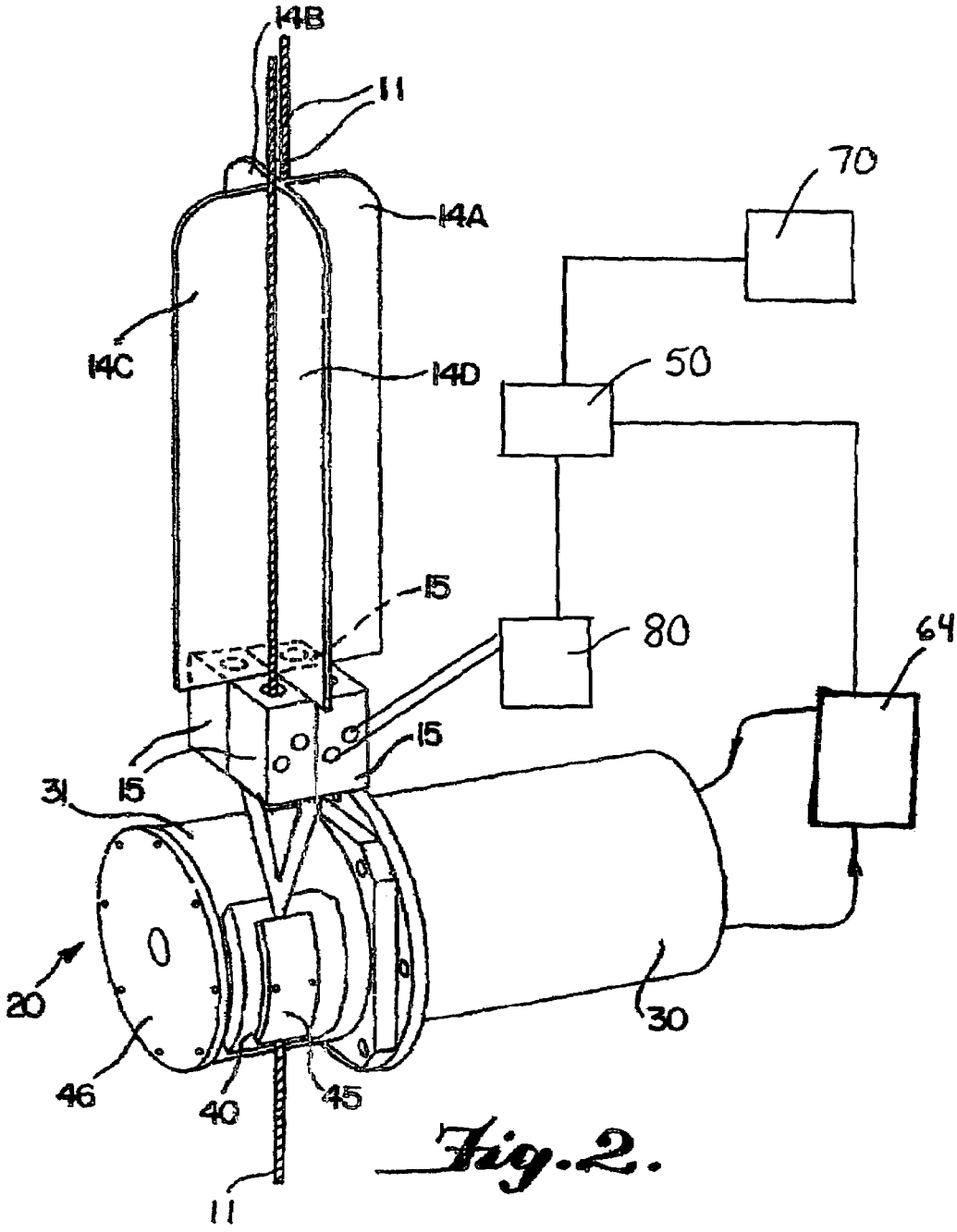
FIG. 2 is a view of the rotary fluid-jet assembly shown in FIG. 1.

Referring to FIG. 2, and according to various embodiments, the rotary air jet assembly 20 can include yarn separators 14A, 14B, 14C and 14D, that serve to keep the individual yarns 11 from touching and twisting together before passage into the twist inserting apparatus 15. The yarn 11 above the air twist apparatus 15 can be twisted in one direction, and the yarn between the twist inserting apparatus 15 and the rotary air jet assembly 20 can be twisted in the opposite direction, with the number of twists per length of yarn being controlled by the amount of the air that is supplied to the twist inserting apparatus 15, as controlled by the programmable controller 64.

As shown schematically in FIG. 2, and according to various embodiments, the programmable controller 64 can provide control signals to a pressure transducer 50, with the pressure transducer controlling the pressure of air or another fluid supplied from a source of air or another fluid 70 to one or more solenoid valves 80. The air or other fluid at a desired pressure and flow rate is then supplied to the twist inserting apparatus 15.

Figure 5:
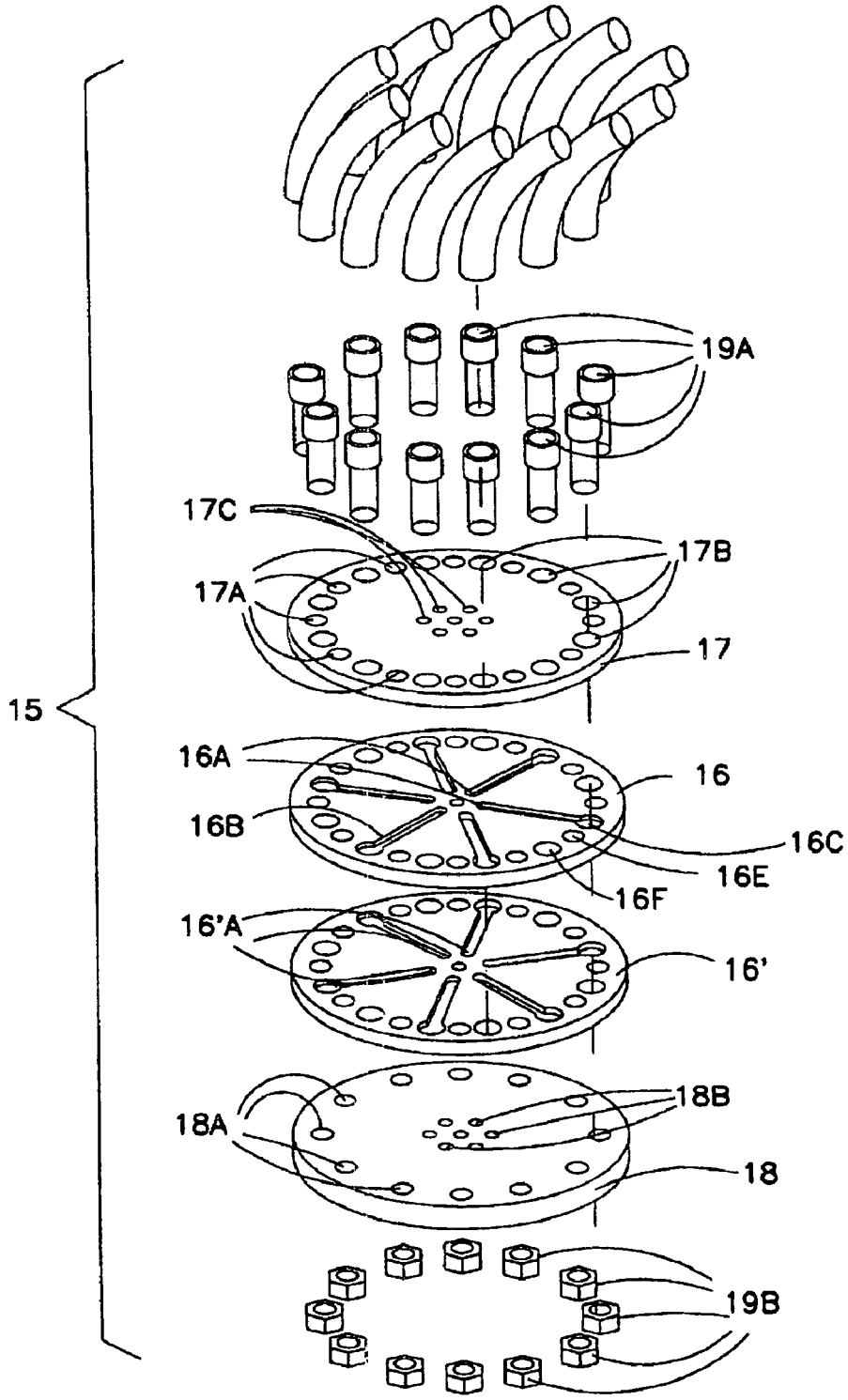
FIG. 5 is an exploded perspective view of the fluid-jet twisting apparatus in the rotary fluid-jet assembly of FIG. 4.
Figure 6:
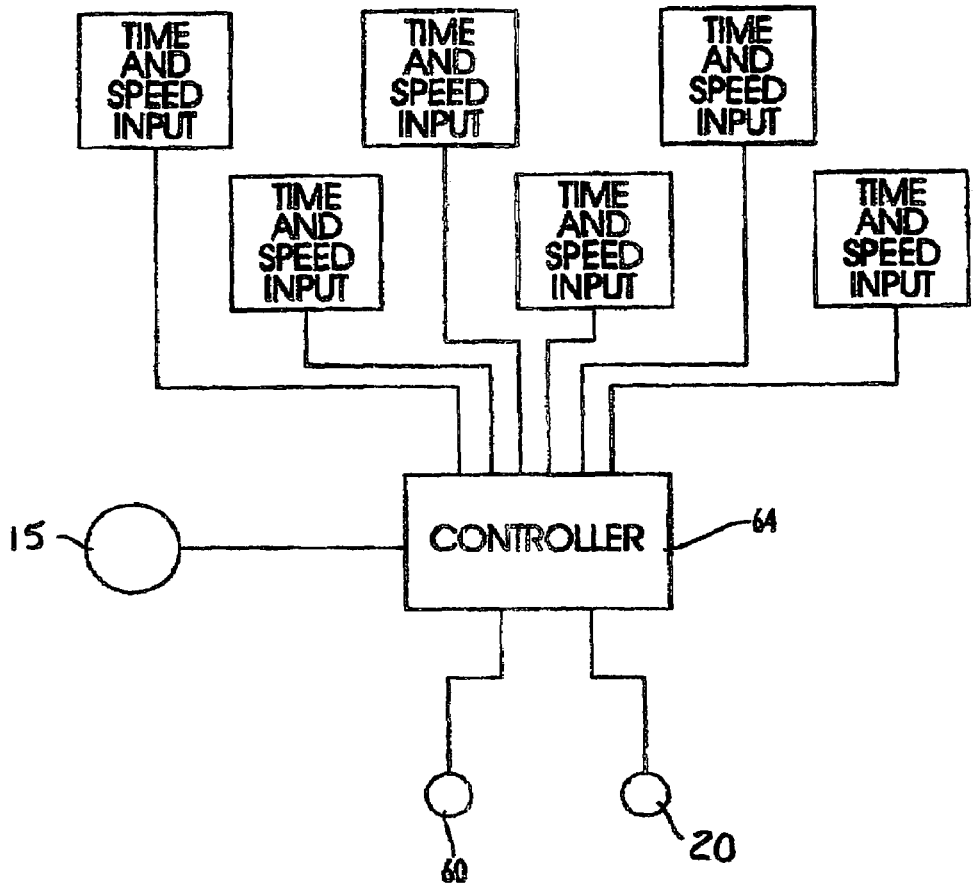
FIG. 6 is an electrical flow diagram for the control of the motors and fluid-jet assembly for the yarn twisting apparatus according to various embodiments.

According to various embodiments, and as shown in the exemplary embodiment of FIG. 4 and FIG. 5, the twist inserting apparatus 15 can be formed from two disks 16 and 16'. An identical pattern of channels, nozzles and orifices can be cut into both disks to permit the disks to be placed in overlying relation to each other and sandwiched between top end block 17 and bottom end block 18 so that either disk can be used to insert S-twist and Z-twist by inverting one disk 16, 16' against the other disk 16, 16'. The top block 17 can operate as an air feed manifold and distribute air from the remote source 70 of pressurized air to the twist inserting apparatus 15 under the control of programmed solenoid valve/s 80, pressure transducer/s 50 and programmable controller 64. The top block 17 and bottom block 18 can be held together using machine screws 19A, which extend through holes in the disks 16, 16' and block holes 17A, 18A, and are captured by nuts 19B. As described in more detail in U.S. Pat. No. 6,345,491, which is incorporated herein in its entirety by reference, yarn orifices 17C and 18B can be formed in respective blocks 17 and 18, and yarn orifices 16A, 16'A can be formed in the disks 16, 16'. Yarn orifices 16A can be radially spaced along air channels 16B from air supply orifices 16C, with the channels 16B communicating with yarn orifices 16A such that air entering the yarn orifices 16A from the channels 16B creates a cyclonic air circulation pattern. This air movement contains sufficient energy to cause the yarn moving through yarn orifices 16A to be twisted about its own axis. The amount of twist inserted into the yarn or the twist level, can be varied by controlling the pressure of the air supplied to the air channels 16B from air supply orifices 16C.

Figure 3:
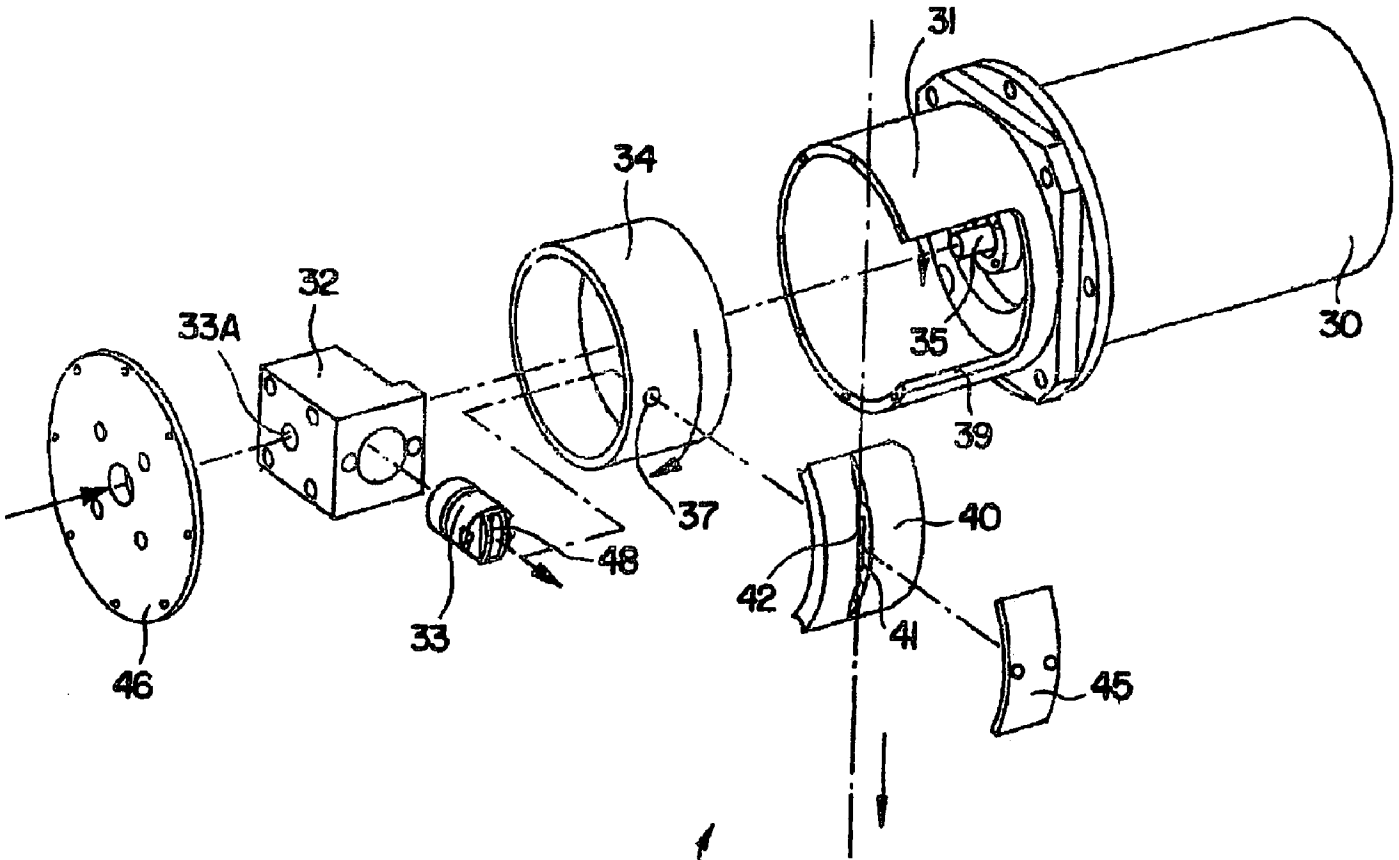
FIG. 3 is an exploded view of a rotary fluid-jet assembly according to an embodiment.

According to various embodiments, and as shown in FIG. 2, FIG. 3, and FIG. 4, the yarn having twists imposed by twist inserting apparatus 15 can then be passed through the rotary air jet assembly 20. The rotary air jet assembly 20 is provided with a drive motor 30 and a protective shroud 31 that is positioned on one side of the motor 30 and encloses several components of the rotary air jet assembly 20. A manifold housing 32 can be mounted in the shroud 31, as shown in FIG. 3, and carries an air manifold 33 which supplies pressurized air to the rotary air jet assembly 20. A rotating, cylindrical air jet can be carried for rotation on the motor shaft 35 of the drive motor 30. Rotating nozzle 34 is provided with an air jet orifice 37 through which air may pass at predetermined intervals. A yarn twister plate 40 is provided within a cutaway section 39 defined by the walls of shroud 31. The plied yarns 11 exiting twist inserting apparatus 15 pass through a vertically oriented yarn slot 41 defined within yarn guide plate 40. An orifice 42 in the yarn slot 41 communicates with the air jet nozzle 34. The yarn guide plate 40 fits over the cutaway section 39 to guide the plied yarn 11 pass the air jet nozzle 34. A cover 45 positioned over the yarn slot 41 of the yarn guide plate 40 prevents uncontrolled escape of air from the proximity of the yarn 11, thereby producing in cooperation with the yarn guide plate 40 the air turbulence which entangles the yarn 11.

In addition to controlling the rate at which motor 60 rotates the take-up rolls 22, 23, the controller 64 can also control drive motor 30 on the rotary air jet assembly 20 as well as the injection of air through twist inserting apparatus 15. Air provided through the air jet orifice 37 in rotary air jet assembly 20 can be used to supplement the twist that has already been provided to the yarn by twist inserting apparatus 15, or can be used to entangle the yarn 11 after the twisted strands have been brought together to "self-twist" into a plied yarn, with the entangling of the plied yarn being performed in sections that separate sections of the yarn having twist in different directions. Although only one air jet orifice 37 is shown on the air jet nozzle 34 in FIG. 3, more than one orifice 37 could also be provided such that additional twist reversal points or areas of entangled fibers could be provided at varying distances from each other along the yarn passing through the rotary air jet assembly 20.

Referring to FIG. 3, air is ejected from manifold 33 through outlet port 48. The forward walls of the manifold 33 defining the air outlet port 48 are arcuately shaped to seal against the inside wall of rotating air-jet nozzle 34. As air-jet nozzle 34 rotates, the air-jet orifice 37 moves past the air outlet port 48. Each complete rotation thus creates a pulse of pressurized air which passes through the air outlet port 48, the air-jet orifice 37, the yarn slot orifice 42 and into the yarn slot 41 in the yarn guide plate 40. If the yarn 11 is traveling with the same velocity as the air-jet orifice 34, the air-jet nozzle will act on a given spot on the yarn for each passage of the air-jet orifice 37 past the yarn slot 41. By increasing or decreasing the velocity of the air-jet nozzle 34 relative to the velocity of the yarn 11 through the yarn slot 41, and past the yarn slot orifice 42, the length of yarn acted on by air flowing from the air-jet nozzle 34 can be controlled with a very high degree of precision. This air flow can be used to produce a desired length section of yarn with a twist reversal, or alternatively, can be used to enhance twist already incorporated into the yarn by the twist inserting apparatus 15. The position of the air-jet orifice 37 can also be varied with respect to the yarn slot orifice 42, such that it is laterally centered, or shifted off-center relative to the axis of the yarn.

The twist level of the yarn, the length segments of the yarn having particular twist levels, the direction of twist and the spacing of twist reversal segments generated by the rotary air jet assembly 20 all affect the final characteristics of the finished twisted yarn that is wound onto the product package roll 12. Depending on the desired characteristics of the finished yarn, the programmable controller 64 can be programmed to produce a desired pattern by providing information to the controller 64 such as the desired rotating speed for motors 60 and 30, as well as controlling the supply of air to the rotary air jet assembly 20 and to the twist inserting apparatus 15.

As illustrated in FIG. 4, and in accordance with various embodiments, if it is desired to produce a finished yarn having a pattern with six different twist segments, the controller 64 can receive programmed input of the speeds at which each of the motors must run for a given period of time as well as the pressure and/or flow rate of air that must be provided to the twist inserting apparatus 15 and the rotary air jet assembly 20 for given periods of time for each segment of the pattern. This information can then be directed by the controller 64 to respective output channels of the controller, which then provide control signals to the drive motor 60, the drive motor 30 of rotary air jet assembly 20, pressure transducer 50 and solenoid valves 80, or other air control devices for twist inserting apparatus 15 and the rotary air jet assembly 20. The controller 64 therefore uses this programmed information in accordance with desired patterns of twist to be provided to the yarn in producing a finished twisted yarn that is wound upon the package roll 12 or otherwise collected or processed.

Where the motors 60, 30 are servo motors, the controller 64 may be a conventional microprocessor-based programmable industrial controller such as those marketed by Giddings & Lewis of Fond du Lac, Wis., U.S.A. under the trademark PiC900. This controller provides motion control of servo motors and drives in a simple manner such that it is readily usable with the twisting system according to various embodiments. A RAM (random access memory) disk stores data for the pattern selection. At each instant of the pattern the controller instructs each servo motor drive to drive the servo motor at a selected speed in accordance with the twist level called for by the pattern, as well as instructing the air control devices to provide the desired flow rate and direction of air flow to achieve the desired twist characteristics. Thus, the air supply to twist inserting apparatus 15 and air jet assembly 20, the speed of the air jet orifice 32, the speed of the take-up rolls 22, 23, and the time periods during which desired air pressures, flow rates of air and/or speeds of the one or more rotating air jet orifices and/or speeds of the take-up rolls are applied, can all be controlled in accordance with the desired pattern.

Figure 7:
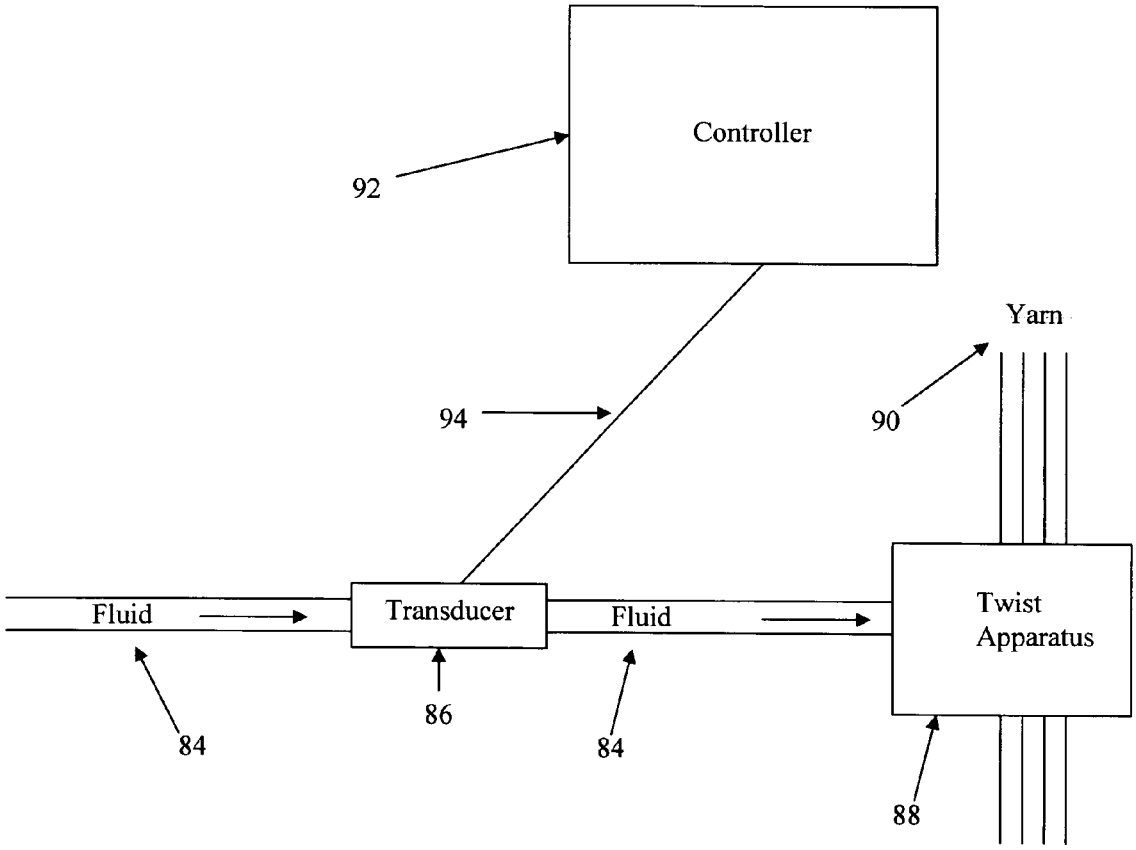
FIG. 7 is a view of an embodiment using a transducer to control the fluid for twisting.

Referring to FIG. 7, FIG. 7 relates to an embodiment of the present invention which uses a transducer 86 or similar device to control the fluid 84, such as air, used for the twisting of the yarn 90 to achieve the desired twist characteristics. Any commercially available transducer can be used in this set-up. The transducer has the ability to be computer controlled by wire 94 or wireless operation or otherwise controlled by a controller 92 in order to determine its operation. Any pattern, regular or irregular, can be preprogrammed by way of the controller 92 in order to achieve the desired twist characteristics for purposes of the present invention. The transducer has the ability to control the amount of fluid, such as air, going into the twist apparatus 88 or it can completely stop the amount of fluid going into the twist apparatus. Preferably, the transducer alters the amount of fluid going into the twist apparatus which in turn will control the twist characteristics. By the use of such a transducer, a variation of twisting characteristics can be achieved. This transducer or similar device can be used in any of the embodiments of the present invention to control the fluid flow in order to achieve the desired flow rate thereby achieving the desired twist characteristics or variation in twist characteristics.

The pattern may, for example, begin with 33 inches of a 1.5 turns of twist per inch, 37 inches of two turns per inch of twist, 41 inches of 2.5 turns per inch of twist, 29 inches of four turns per inch of twist, five inches of 6.5 turns of twist per inch, etc. Carpet and/or other textile substrates can be produced using the twisted yarn with varying twist levels to achieve a desired aesthetic result.

The present invention, in addition, relates to variable air twisted yarn. The variable air twisted yarn can be made by the process described above. The yarn that is used and twisted can be any type of yarn. For instance, the yarn can be natural or synthetic yarn. Examples include solution dyed yarn, polyester, polyamide, polyolefin fibers, and co- or ter-polymers thereof. The variable air twisted yarn can have one or more, and preferably two or more, different twist levels present in the length of yarn. In other words, the yarn can have one portion of the yarn with a first number of twists per inch and another portion of the yarn can have a second number of twists per inch, wherein the first number of twists per inch is different from the second number of twists per inch. The number of twists can be any number as described above, such as from ½ to 10 twists per inch or more. The present invention further relates to textile substrates, such as various types of carpet, which contain at least a portion of the variable air twisted yarn. The carpet can be rolled carpet or carpet tiles of any size. For instance, the rolled carpet can be 6 ft to 12 ft rolled carpet. The remaining components of the carpet and the manner of making the carpet are conventional except for the use of the variable air twisted yarn of the present invention. The carpet can be piled or looped. For instance, the variable air twisted yarn can be tufted into a primary backing and then a pre-coat layer can be applied to lock the tufts in. Any number of intermediate layers and a secondary backing can be used, which are conventional in the industry. For instance, the layers and materials and processes described in U.S. Pat. Nos. 6,510,872; 6,479,125; 6,468,623; 6,435,220; 6,217,974; 6,203,881, 6,051,300; 5,962,101; 5,800,898; 6,497,936; 6,316,075; and, 5,540,968 can be used, and these patents are incorporated in their entirety by reference herein.

Numerous alterations of the structure herein disclosed will suggest themselves to those skilled in the art. However, it is to be understood that the present disclosure relates to various embodiments, and is for purposes of illustration only and not to be construed as a limitation of the various embodiments. All such modifications which do not depart from the spirit of the various embodiments are intended to be included within the scope of the appended claims.

What is claimed:

1. A method for twisting at least two yarn strands together into a twisted yarn product, comprising:

providing a supply of the yarn strands;

providing at least one fluid jet device having a controllable fluid blast;

providing a rotatable feed roll;

storing in a programmable controller data for control of the at least one fluid jet device and the rotatable feed roll in a manner suitable to generate a pattern made up of variations in at least one of the twist level and the direction of twist of a finished twisted yarn product along the length of the yarn;

controlling the fluid blast from the at least one fluid jet device to effect a desired yarn twist on the yarn strands;

controlling rotation of the feed roll to feed the yarn strands at a predetermined speed of travel between the supply of yarn strands, the at least one fluid jet device and a package of the finished twisted yarn product; and controlling the fluid blast and the rotation of the feed roll according to the data stored in the programmable controller to provide at least one of a first twist level and a first twist direction of the yarn for a first length of the finished twisted yarn product, and at least one of a second twist level and a second twist direction of the yarn for a second length of the finished twisted yarn product.

2. The method of claim 1, wherein rotation of the feed roll comprises feeding the yarn strands to the fluid jet device and to the package of the finished twisted yarn product.

3. The method of claim 1, wherein control of the fluid blast comprises control of the pressure of fluid supplied to one or more orifices through which the yarn strands are passed.

4. The method of claim 3, wherein the fluid supplied to the one or more orifices through which the yarn strands are passed creates a cyclonic fluid circulation pattern within the one or more orifices, with the direction of the fluid circulation pattern determining the direction of twist imposed by the fluid on the yarn strand.

5. The method of claim 1, wherein the fluid blast is controlled by moving the fluid blast at a rate of speed approximately equal to the speed of travel of the yarn strands to effect twisting of the yarn strands at a predetermined position along the length of the yarn strands.

6. The method of claim 1, wherein the fluid blast is controlled by moving the fluid blast at a rate of speed different from the speed of travel of the yarn strands to effect twisting of the yarn strands along a length of the yarn strands.

7. The method of claim 1, wherein the fluid blast is controlled to move at a first rate of speed relative to the speed of travel of the yarn strands to provide a first zone of intermingled yarn strands in the finished twisted yarn product, and the fluid blast is controlled to move at a second rate of speed relative to the speed of travel of the yarn strands to provide a second zone of intermingled yarn strands in the finished twisted yarn product.

8. The method of claim 1, wherein controlling the fluid blast comprises directing the fluid blast tangentially to the yarn strands to generate a twisting torque on the yarn strands.

9. The method of claim 6, further including bringing at least two yarn strands together after they have been subjected to twisting torque from the fluid blast so that a release of the twisting torque contributes to the entwining of the at least two yarn strands.

10. The method of claim 1, wherein controlling the fluid blast to effect a desired yarn twist comprises providing an enclosed area having an orifice directed at a path of the yarn strands through the enclosed area, and the fluid jet device intermittently directing the fluid blast through the orifice and into contact with the yarn strands.

11. The method of claim 1, wherein the at least two yarns are each provided individually with a desired twist level over a predetermined length by exposing each of the yarns to a twisting torque generated by the fluid blast impinging tangentially on the yarn.

12. The method of claim 9, wherein two or more of the at least two yarns having the desired twist levels are brought into contact with each other and become entwined with each other as a result of a release of the twisting torque.

13. The method of claim 10, wherein a fluid blast from one of the at least one fluid jet device is directed against zones of the entwined yarns to create areas of intermingled yarns in areas of zero twist.

14. A system comprising:

a supply of yarn strands;

at least one fluid jet device adapted to impose a twisting torque on individual yarn strands;

a rotatable feed roll adapted to feed the yarn strands at a predetermined speed of travel between the supply of yarn strands, the at least one fluid jet device and a package of the finished twisted yarn product; and a control device that selectively rotates the rotatable feed roll at selected speeds and operates the at least one fluid jet device in accordance with desired control parameters such as pressure and flow rate for a selected first time period to provide at least one of a first twist level and a first twist direction of the yarn strands for a first length of the finished twisted yarn product, and that selectively rotates the rotatable feed roll at selected speeds and operates the at least one fluid jet device in accordance with desired control parameters such as pressure and flow rate for a selected second time period to provide at least one of a second twist level and a second twist direction of the yarn strands for a second length of the finished twisted yarn product.

15. A device for twisting at least two yarn strands together into a finished twisted yarn having a twist level varied along its length in accordance with a pattern, comprising:

at least one fluid jet device having fluid jets positioned in relationship to individual strands of yarn and adapted to impose selected twisted torques on the strands of yarn, the fluid jet device further comprising a controllable fluid blast adapted to reverse the twist imposed on the strands of yarn by the fluid jets in selected zones along the length of entwined strands of yarn;

a rotatable feed roll adapted to feed yarn strands at a predetermined speed of travel between a supply of yarn strands, the at least one fluid jet device and a package of the finished twisted yarn product;

a drive means for selectively rotating the rotatable feed roll at selected speeds for a selected time period;

a control means for selectively moving the controllable fluid blast at selected speeds relative to the speed of travel of the yarn strands; and a programmable controller for selectively varying the speeds and time periods in accordance with the pattern.

* * * * *